US007591666B2

(12) United States Patent
Legrady et al.

(10) Patent No.: US 7,591,666 B2
(45) Date of Patent: Sep. 22, 2009

(54) SURFACE MOUNT CRIMP TERMINAL AND METHOD OF CRIMPING AN INSULATED CONDUCTOR THEREIN

(75) Inventors: Janos Legrady, Putnam Valley, NY (US); Raffaelle Tarulli, Irvington, NY (US); Ronald Fredriks, Pine Plains, NY (US)

(73) Assignee: Zierick Manufacturing Corporation, Radio Circle, Mount Kisco, NY (US)

( * ) Notice: Subject to any disclaimer, the term of this patent is extended or adjusted under 35 U.S.C. 154(b) by 0 days.

(21) Appl. No.: 11/595,249

(22) Filed: Nov. 10, 2006

(65) Prior Publication Data

US 2008/0113553 A1 May 15, 2008

(51) Int. Cl.
*H01R 4/24* (2006.01)

(52) U.S. Cl. ..... 439/424

(58) Field of Classification Search ..... 439/424, 439/421, 422, 423, 876, 877, 940; 72/409.14, 72/409.16

See application file for complete search history.

(56) References Cited

U.S. PATENT DOCUMENTS

| | | | | | |
|---|---|---|---|---|---|
| 1,706,005 | A | | 3/1929 | Thompson | |
| 2,501,870 | A | * | 3/1950 | Malhiot | 439/424 |
| 3,009,010 | A | * | 11/1961 | Stearns et al. | 174/72 A |
| 3,320,354 | A | * | 5/1967 | James et al. | 174/84 C |
| 3,395,381 | A | * | 7/1968 | Clifton | 439/422 |
| 3,410,950 | A | * | 11/1968 | Freudenberg | 174/84 C |
| 3,412,701 | A | * | 11/1968 | Johannes | 29/874 |
| 3,435,126 | A | * | 3/1969 | Hamilton | 174/78 |
| 3,455,022 | A | * | 7/1969 | Schmitz, Jr. et al. | 29/859 |
| 3,514,528 | A | * | 5/1970 | Ray | 174/84 C |
| 3,539,707 | A | * | 11/1970 | Kindell et al. | 174/84 C |
| 3,553,347 | A | * | 1/1971 | Harding et al. | 174/84 C |
| 3,728,473 | A | * | 4/1973 | Kuo | 174/84 C |
| 3,950,065 | A | * | 4/1976 | Renn | 439/398 |
| 3,960,430 | A | * | 6/1976 | Bunnell et al. | 439/422 |
| 4,039,244 | A | * | 8/1977 | Leachy | 439/887 |
| 4,464,541 | A | * | 8/1984 | Ceresa et al. | 174/84 C |
| 4,749,368 | A | * | 6/1988 | Mouissie | 439/421 |
| 4,834,672 | A | | 5/1989 | Michely | |
| 4,945,192 | A | * | 7/1990 | Urushibata et al. | 174/94 R |
| 5,004,869 | A | * | 4/1991 | Koblitz et al. | 174/84 C |
| 5,151,560 | A | * | 9/1992 | Kreinberg et al. | 174/94 R |

(Continued)

FOREIGN PATENT DOCUMENTS

| | | |
|---|---|---|
| DE | 4033366 | 4/1992 |

(Continued)

*Primary Examiner*—T C Patel
*Assistant Examiner*—Vladimir Imas
(74) *Attorney, Agent, or Firm*—Lackenbach Siegel, LLP; Myron Greenspan

(57) ABSTRACT

A surface mount insulation terminal is formed of flat deformable conductive member to provide a substantially uniform U-shaped cross-section to form a wire-receiving channel. One or more piercing spikes are formed on a bottom wall of the channel and point to an opposing open side through which a conductor may be introduced. Ribs inside the channel provide an interference fit with a conductor introduced into the channel. A crimping tool lowered into engagement with the terminal after it has been soldered to a PCB increasingly deforms the side walls of the terminal inwardly towards each other and towards the bottom wall to enhance the electrical and mechanical properties of the resulting termination.

17 Claims, 3 Drawing Sheets

U.S. PATENT DOCUMENTS

| | | | | |
|---|---|---|---|---|
| 5,330,367 | A | 7/1994 | Janczak | |
| 5,385,483 | A * | 1/1995 | Lin | 439/424 |
| 5,611,709 | A * | 3/1997 | McAnulty | 439/422 |
| 5,658,163 | A * | 8/1997 | DeRoss | 439/424 |
| 5,674,097 | A * | 10/1997 | McCleerey | 439/863 |
| 6,232,555 | B1 * | 5/2001 | Besler et al. | 174/84 C |
| 6,261,119 | B1 | 7/2001 | Green | |
| 6,350,145 | B1 * | 2/2002 | Chen et al. | 439/422 |
| 6,475,027 | B1 * | 11/2002 | Boldt et al. | 439/496 |
| 6,565,376 | B2 * | 5/2003 | Aoki | 439/422 |
| 6,997,028 | B2 * | 2/2006 | Schmode | 72/409.16 |
| 7,040,914 | B2 * | 5/2006 | Kuwayama et al. | 439/422 |
| 7,129,421 | B2 | 10/2006 | Reis et al. | |
| D543,429 | S * | 5/2007 | Norin | D8/52 |
| D544,323 | S * | 6/2007 | Hutchfield | D8/52 |
| 2006/0042346 | A1 * | 3/2006 | Holliday et al. | 72/409.14 |

FOREIGN PATENT DOCUMENTS

| | | |
|---|---|---|
| DE | 102004049575 | 4/2006 |
| FR | 2842029 | 1/2004 |

* cited by examiner

SURFACE MOUNT CRIMP TERMINAL AND METHOD OF CRIMPING AN INSULATED CONDUCTOR THEREIN

BACKGROUND OF THE INVENTION

1. Field of the Invention

This invention generally relates to a electrical connectors and, more specifically, to surface mount crimp terminals and method of crimping insulated conductor therein.

2. Description of the Prior Art

Typically, to terminate a wire to a surface mount printed circuit board a two-piece connection system is used. Usually, a receptacle is crimped onto the wire and the mating tab or pin is surface mounted on the printed circuit board ("PCB"). A less expensive solution is a one terminal system like the insulation displacement connector ("IDC"). Most surface mount IDC's are fairly large, require substantial amount of real estate on the board because of their large footprints and do not provide good strain relief on the wire.

SUMMARY OF INVENTION

Accordingly, it is an object of the present to provide a surface mount crimp terminal that does not have the disadvantages inherent in such prior terminals or contacts.

It is another object of the invention to provide a surface mount terminal that is simple in construction and economical to manufacture.

It is still another object of the invention to provide a terminal of the type suggested in the previous objects which requires a small footprint on the printed circuit board.

It is yet another object of the present invention to provide a terminal of the type under discussion which provides excellent strain relief for the wire.

It is a further object of the invention to provide a terminal of the type under discussion that can be readily and efficiently used with automatic pick and place equipment.

It is still a further object of the invention to provide a terminal as in the aforementioned objects which provides fast, reliable and efficient mounting on printed circuit boards and termination of insulated conductors therein which may have the insulation pre-stripped or pierced by the terminal during crimping.

In order to achieve the above objects, as well as other which will become apparent hereinafter, a surface mount crimp terminal in accordance with the present invention for connection to an insulated conductor having a predetermined substantially uniform external cross-sectional dimension comprises a generally flat deformable conductive member configures to have a generally uniform U-shaped cross-section to define a wire-receiving channel having a bottom wall, suitable for attachment by surface mounting (SM) to a land or pad on a printed circuit board and providing a generally central flat surface area suitable for cooperation with a vacuum nozzle of a pick-and-place machine. A pair of spaced substantially parallel side walls are provide for receiving a length of an insulated conductor between said side walls through an open side opposite to said bottom wall. Said side walls are spaced from each other a distance substantially equal to the external cross-sectional dimension of the insulated conductor. A conductor may have its end pre-stripped and the exposed conductor wires placed within the receiving channel prior to the crimping. Alternatively, insulation piercing means may be provided within said channel for piercing insulation on an insulated conductor upon application of a force applied urging the insulated conductor into said channel towards said bottom wall. Said side walls are capable of being crimped or bent inwardly toward each other and toward said bottom wall to at least partially close or reduce the dimensions of said open side to urge and maintain the pre-stripped conductor or the pierced insulated conductor within said channel.

A method of securing an insulated conductor to a printed circuit board using the surface mount insulation terminal in accordance with the invention includes positioning said bottom wall on a land or pad of a printed circuit board. The terminal is mechanically attached to the land or pad, such as by soldering. A length of the insulated conductor is at least partially inserted into said channel. The terminal is then crimped by deforming said side walls towards each other and towards said bottom wall to urge the insulated conductor further into said channel for either making electrical contact with the exposed wires of a pre-stripped conductor or piercing the insulation with insulation piercing means and at least partially closing or reducing the dimensions of said open side to prevent the crimped insulated conductor from moving out from within said channel. A crimping tool in accordance with the invention, for crimping a terminal as aforementioned, comprises a movable block capable of being aligned with and applying a pressure on said side walls. Said block has a recess having a width substantially equal to the spacing between said side walls for initially receiving said side walls within said recess when the crimping tool is positioned at a predetermined height above said bottom wall. Said recess exhibits gradually decreasing width interacting with said side walls as said height is gradually decreased below said predetermined height. Pressure applying pressure means is provided for selectively applying on such crimping tool to deform and crimp said side walls to secure the conductor in place.

The surface mount insulation terminals in accordance with the invention may be formed from a blank which includes coined triangular-shaped members formed in said bottom wall capable of being bent to an orientation substantially normal to said bottom wall. Such blanks may be produced in a continuous strip and selectively severed from each other prior to being formed into the final U-shaped configuration of the terminal.

BRIEF DESCRIPTION OF THE DRAWINGS

The above and other objects, features and advantages of the present invention will be better understood from the following specification when read in conjunction with the accompanying drawings.

DESCRIPTION OF PRESENTLY PREFERRED EMBODIMENT

Figure 1:
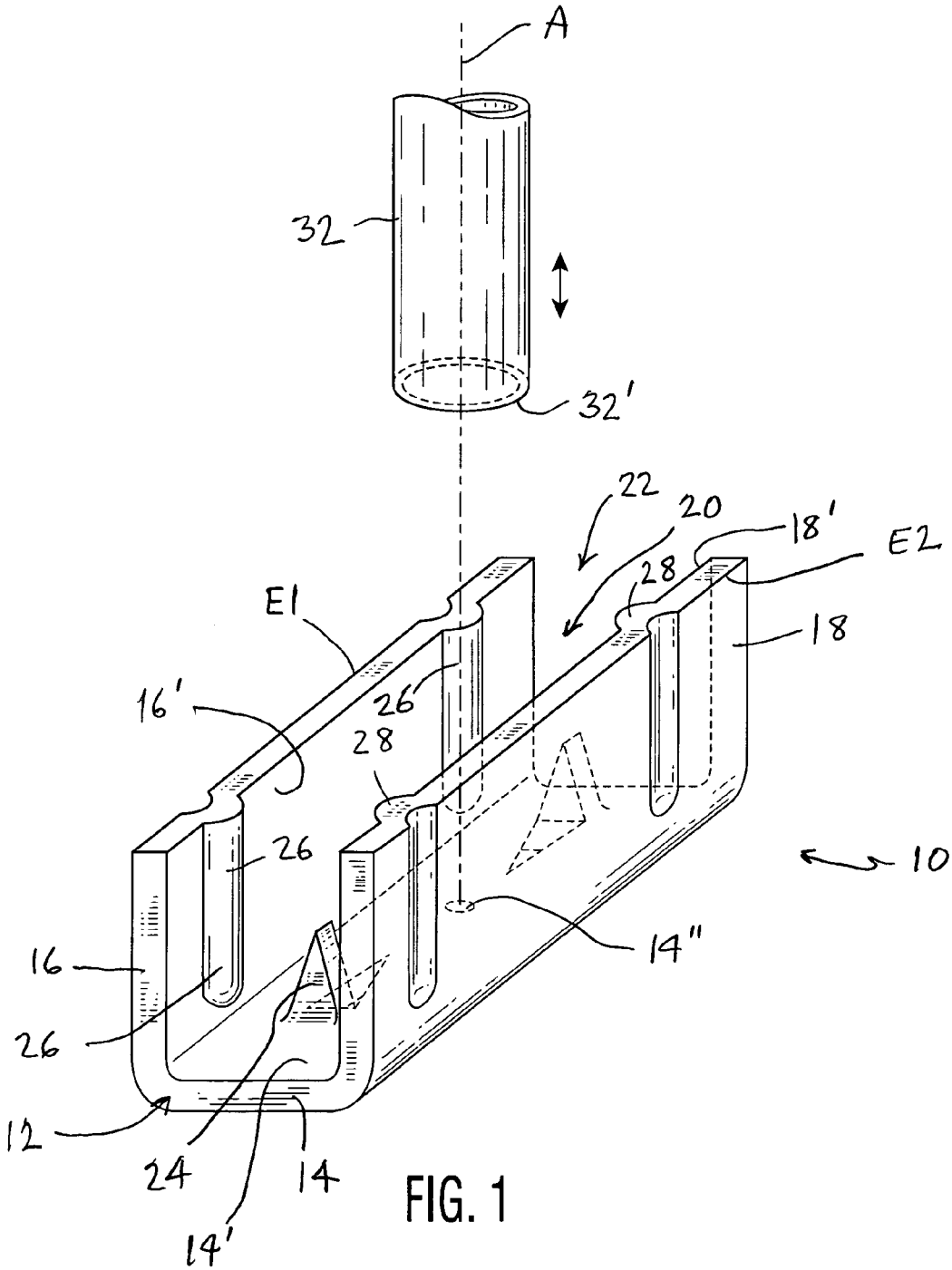
FIG. 1 is a perspective view of a surface mount insulation piercing crimp terminal in accordance a presently preferred embodiment of the present invention, shown with a vacuum nozzle of a pick-and-place machine for cooperating with a flat surface of the terminal to pick up or deposit the terminal on a printed circuit board.

Referring now specifically to the Figures, in which the identical or similar parts are designated by the same reference numerals throughout, and first referring to FIG. 1, a surface mount (SM) insulation piercing crimp terminal in accordance with the present invention is generally designated by the reference numeral 10.

While the presently preferred embodiment to be described is for a surface mount insulation displacement connector (IDC) the invention also contemplates to use of such SM crimp connectors or terminals that have ends pre-stripped of insulation that can be similarly crimped.

Figure 2:
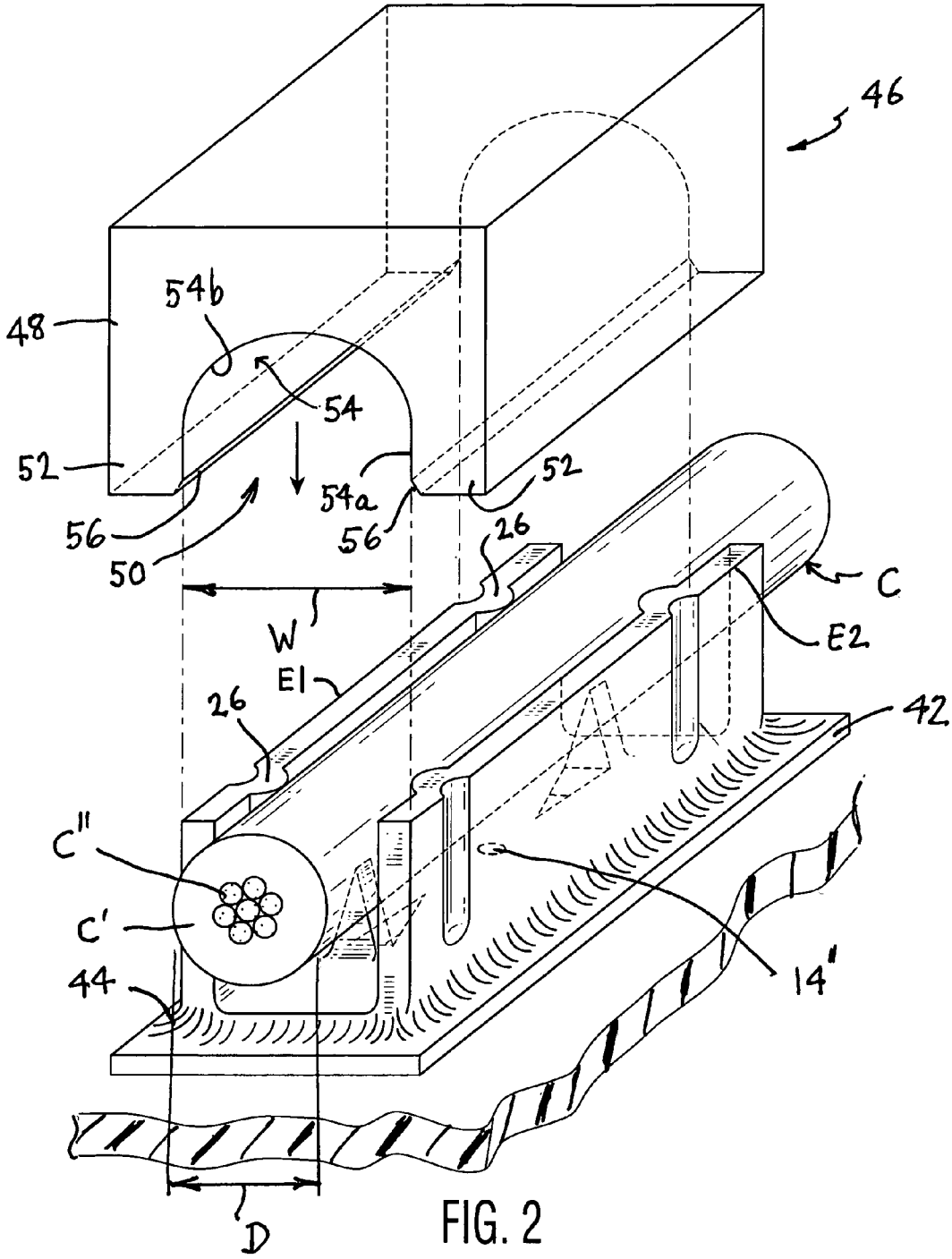
FIG. 2 is a perspective view of the terminal shown in FIG. 1, after being mounted or attached to a printed circuit board, such as by soldering, and further showing a crimping tool in the form of a press prior to engagement and crimping of the terminal to pierce the insulation of the insulated conductor and secure the termination.

The terminal 10 is useful for connection to an insulated conductor C having a predetermined substantial uniform external cross-sectional dimension. In FIG. 2, the insulated conductor is shown to have a substantially uniform circular cross-sectional dimension having a diameter of D. The conductor C includes an sheath of electrical insulation C' and central conductors or wires C" imbedded centrally along the axis of the conductor.

Figure 5:
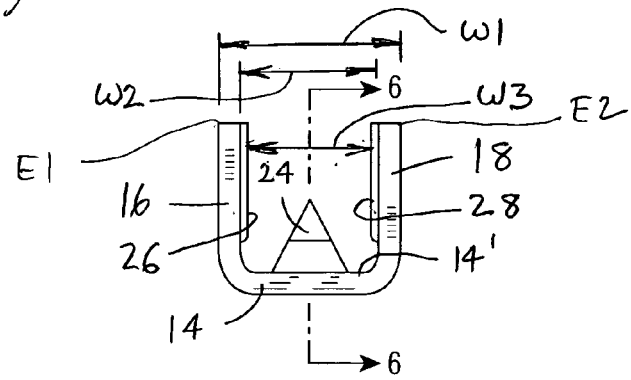
FIG. 5 is an end elevational view of the crimp terminal in accordance with the invention, illustrating the piercing spikes in their operational positions.

The crimp IDC terminal 10 is formed of a generally flat deformable conductive member 12 configured to have a generally uniform U-shaped cross-section as shown in the figures, and best exemplified in FIG. 5. The conductive member 12 defines a wire-receiving channel 20 having a bottom wall 14 defining an interior surface 14', suitable for attachment to a land or pad 42 on a printed circuit board 40 as shown in F*ig*. 2.

A pair of spaced substantially parallel side walls 16, 18 are substantially normal to the bottom wall 14. The walls 14, 16 and 18 form the channel 20 for receiving a length of an insulated conductor between the side walls through an open side or top opening 22 opposite the bottom wall 14. The side walls 16, 18 are spaced from each other a distance substantially equal to the external cross-sectional dimension of the insulated conductor C, the diameter D in the example shown in FIG. 2.

Insulation piercing means is provided within the channel 20 for piercing the insulation C' on the insulated conductor C positioned between the side walls 16, 18 upon application of a force applied to the conductor urging the conductor into the channel 20 towards the bottom wall 14. In accordance with a presently preferred embodiment, the insulation piercing means are in the form of a plurality of insulation piercing spikes 24 that project form the bottom wall 14 towards the open side or open end 22. While a single spike may be provided a plurality of spikes are advantageously used to optimize the electrical contact between the terminal 10 and the central conductors C".

To optimize termination and increase the efficiency of attaching a conductor to the terminal, there is preferably provided holding means for holding the conductor C within the channel 20 prior to crimping. In accordance with the presently preferred embodiment, protuberance means in the form of ribs 26, 28 or other projections that project into the channel 20 to create an interference fit with the conductor C when at least partially inserted into the channel. While a single rib 26, 28 may be provided, in the presently preferred embodiment, a plurality of ribs 26 are provided on the side wall 16 and a plurality of ribs 28 are provided on the side wall 18. It will be evident that because the insulation C' is deformable the conductor C can be urged into the channel 20, where the insulation deforms to conform to accommodate the ribs 26, 28. Such deformation and forceful insertion of the conductor into the channel 20 creates a friction fit which retains the conductor in place, as shown in FIG. 2. Preferably, the conductor C is urged inwardly or downwardly as shown in the Figures, from the open end or top opening 22 towards the bottom wall 14 to force at least the tips of the piercing spikes to penetrate into the insulation C'. The degree of initial insertion of the conductor into the channel and initial penetration of the piercing spikes into the insulation is not critical as long as the conductor is substantially received within the channel 20 as shown in FIG. 2, where the upper surface of the conductor is substantially coextensive with or slightly below the edges E1, E2 of the side walls 16, 18.

While the insulation piercing spike 24 may be created in any desired manner, in the presently preferred embodiment, the spikes 24 are die-cut or coined and bent from a plane of the bottom wall 14 to the orientations shown in which the spikes are substantially normal to the bottom wall 14 and to point upwardly towards the open end or top opening 22. The piercing spikes 24 are preferably provided proximate to the ribs 26, 28, and away from a central region of the bottom wall 14 which defines a flat pick up area 14" which is suitable for pick up by a vacuum nozzle 32 at a lower peripheral edge or surface 32'. The vacuum nozzle 32 can be used in a well known manner to pick up and position the terminal 10 such that the bottom wall 14 is appropriately aligned on a land or pad 42 of a printed circuit board (PCB) 40. The terminal may then be attached to the land or pad in a conventional manner, such as by solder 44 when the terminal 10 becomes mechanically connected to a land or pad of a PCB 40.

Once the terminal is mechanically attached to the PCB 40, a length of insulated conductor C is at least partially inserted into the channel 20 as shown in FIG. 2. A crimping tool 46 in the form of a block-press 48 may then be used to crimp the terminal as to be described.

Figure 3:
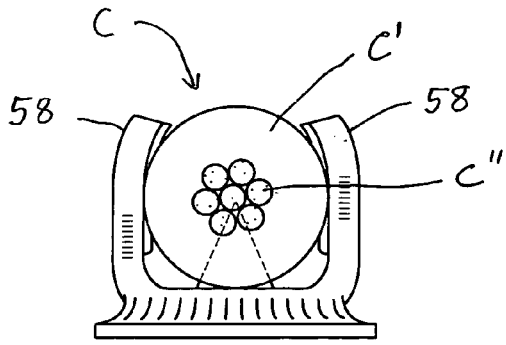
FIG. 3 is an end elevational view of the terminal shown in FIG. 2, after the terminal has been crimped, indicating the manner in which the insulated conductor has been pierced to provide contact between the terminal and the internal conductors and the manner in which the side or lateral walls of the terminal secure and maintain the insulated conductor within the terminal.

The crimping tool 46 includes a downwardly open U-shaped channel 50 to provide skirt portions 52 and an interior surface 54. In order to provide desired crimping action, the spacing W between the skirt portions 52 (FIG. 2) is selected to be substantially equal or slightly larger then the spacing W1 between the outer edges E1, E2 of the side walls 16, 18. Referring to FIG. 5, the spacing W1 between the outer edges E1, E2 is selected to be slightly smaller then the initial width W of the open channel 50. The dimension w2 is the dimension between the inner opposing surfaces of the side walls 16, 18, while the dimension w3 is the width between opposing ribs 26, 28. To facilitate alignment between the side walls 26, 28 and the initial up right surfaces 54*a* of the interior surface 54, lead-in or guide surfaces 56 are provided in the form of inclined edges or bevels as shown. If there is a slight horizontal misalignment between the crimping tool 46 and the terminal 10 the lead-in or guide surfaces 56 will engage the edges E1, E2 and horizontally shift the terminal or the block press 48 to align them and provide the desired alignment. It will be evident that the movable block 48 is capable of being aligned with an applied pressure on the side walls once the block is moved to engage the upright side walls within the open channel or recess 50. Initially, the upper edges of the side walls are received within the recess 50 when the crimping tool is position at a predetermined height above the bottom wall 14. Because of the arcuate shape or configuration 54*b* of the interior surface 54 the side walls are forced inwardly as the height of the block 48 is further decreased below the predetermined height. Continue application of pressure on the press-block selectively applies pressure on the crimping tool to crimp the side walls as suggested in FIG. 3 by forcing the upper edges E1, E2 of the side walls to move inwardly towards each other and downwardly towards the bottom wall. This applies additional downward pressure on the conductor to enhance piercing action by the spikes 24.

As will be noted, the recess or open channel 50 is elongated and comprises a substantial uniform cross-section. When fully lowered, the press-block 48 will deform or crimp the side walls to conform with the arcuate shape of the interior surface 54 of the U-shaped channel. It is clear, however, that other crimping configurations may be used and any press components may be utilized as long the side walls become crimped with the effect of urging the conductor to a desired depth within the channel and the conductor is retained and prevented from inadvertently leaving the channel. It will be appreciated, therefore, that once the terminal is mounted on a PCB 40, a simple application of pressure by the press-block 48 simultaneously produces the desired piercing as well as crimping action to secure the position of the conductor.

Figure 4:
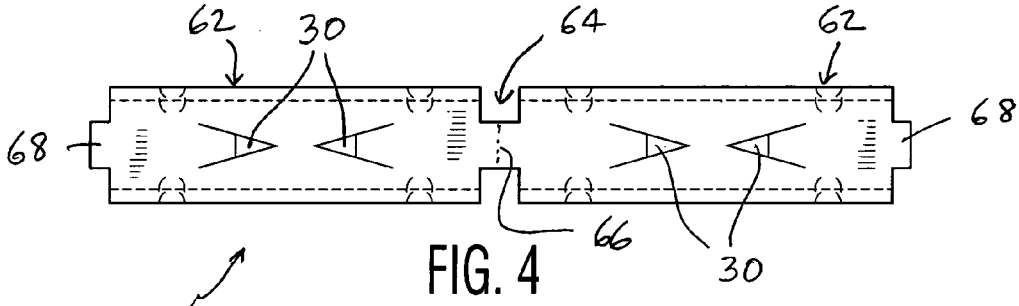
FIG. 4 is a top plan view of two blanks of a continuous strip of blanks that can be used to form the terminals in accordance with the present invention.
Figure 6:
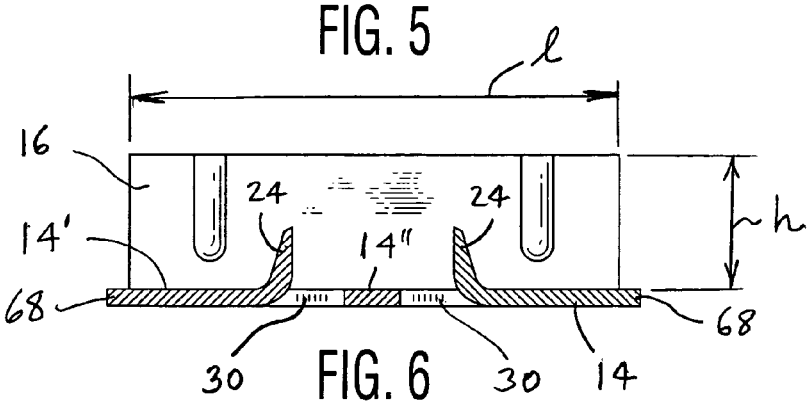
FIG. 6 is a side elevational cross-section of the crimp terminal shown in FIG. 5 taken along line 6-6.

Referring to FIGS. 4 and 6, a blank for forming the terminal in accordance with the present invention is illustrated. It will be clear that the terminals 10 may be formed from a continuous strip 60 die-cut to produce individual blanks 62 connected to each other by means of connecting tabs 64. The connecting tabs are severed along center line 66 prior to forming of the flat strip into the U-shaped terminal. Once severed, resulting tabs 68 may remain at the end of each terminal, as shown in FIGS. 4 and 6. However, the extensions 68 may also be severed and removed if desired.

The die-cut openings 30 resulting from the bending of the spikes upwardly as shown in FIG. 6, creates regions where solder can wick upwardly to fill the openings 30 to provide a better or stronger bond with the PCB 40. The length l, shown in FIG. 6, may be selected to suit a given application. When the side walls are collapsed as suggested in FIG. 3, clearly the longer the terminal the more surface area for crimping interaction between the terminal and the conductor and, therefore, the stronger the termination and the more difficult to remove the conductor. Removal of the conductor by pulling it along the length of the channel 20 is also rendered almost impossible by the piercing action of the spikes 24 which have entered into the insulation and make contact with the central conductors or wires C".

The stiffening ribs 26, 28 have another function which is to temporarily hold the wire in place into crimping. They are sized in such a way that there is a slight interference fit with the wire insulation. Interference will hold the wire until crimping. The crimping tool is attached to a small pneumatic air hammer. It is placed over the terminal, perpendicular to the PCB, in such a way that the two crimp ears line up with the lead-in surfaces of the tool. When the tool 46 is lowered, the impact will curl the crimp ears forcing the wire all the way down so the insulation piercing spikes to penetrate inside the conductive core of the wire making electrical contact.

While the invention has been shown and described in connection with a preferred form of an embodiment it will be understood that modifications may be made without the departure from the scope or spirit of the invention.

The invention claimed is:

1. Surface mount crimp terminal for connection to an insulated conductor having a predetermined substantially uniform external cross-sectional dimension, comprising a generally flat deformable conductive member configured to have an elongate generally uniform U-shaped cross-section along its entire elongate length to define a wire-receiving channel along its length and having a generally flat conductive bottom wall suitable for contact with and attachment to a land or pad on a printed circuit board and providing a generally flat surface area suitable for cooperation with a vacuum nozzle of a pick-and-place machine, and a pair of spaced substantially parallel side walls normally to said bottom wall, for receiving a length of an insulated conductor between said side walls through an open side opposite to said bottom wall, said side walls being spaced from each other a distance substantially equal to the external cross-sectional dimension of the insulated conductor; said side walls being capable of being crimped or bent inwardly towards each other and towards said bottom wall to at least partially close or reduce the dimensions of said open side to urge and maintain mechanical and electrical contact with a conductor within said channel; and insulation piercing means within said channel extending from said flat bottom wall towards said open side for piercing insulation on an insulated conductor positioned between said side walls upon application of a force applied urging the insulated conductor into said channel towards said bottom wall, a generally flat pick-up surface, on said bottom wall within said wire receiving channel, at a point generally at a center of mass or center of gravity to enable a pick-up vacuum nozzle to stably pick up the terminal and move it to a PCB.

2. A terminal as defined in claim 1, wherein said insulation piercing means comprises at least one spike projecting from said bottom wall towards said open side.

3. A terminal as defined in claim 1, further comprising holding means for holding the conductor within said channel prior to crimping.

4. A terminal as defined in claim 3, wherein said holding means comprises protuberance means on at least one side wall projecting into said channel to create an interference fit with the conductor when at least partially inserted into said channel.

5. A terminal as defined in claim 1, wherein said at least one spike is die-cut from said bottom wall and bent in the direction of said open side, leaving cut-outs for receiving solder.

6. Method of securing an insulated conductor to a PCB by means of a surface mount insulation terminal for connection to an insulated conductor having a predetermined substantially uniform external cross-sectional dimension, comprising a generally flat deformable conductive member configured to have an elongate generally uniform U-shaped cross-section along its entire elongate length to define a wire-receiving channel along its length and having a conductive bottom wall suitable for contact with and attachment to a land or pad on a printed circuit board, and a pair of spaced substantially parallel side walls, for receiving a length of an insulated conductor between said side walls through an open side opposite to said bottom wall, said side walls being spaced from each other a distance substantially equal to the external cross-sectional dimension of the insulated conductor, said side walls being capable of being crimped or bent inwardly towards each other and towards said bottom wall to at least partially close or reduce the dimensions of said open side to urge and maintain a pierced insulated conductor within said channel extending from said flat bottom wall towards said open side, the method comprising the steps of positioning said bottom wall on a land or pad of a PCB; mechanically attaching the terminal to the land or pad; inserting a length of an insulated conductor at least partially into said channel; and crimping the terminal by deforming said side walls towards each other and towards said bottom wall to further urge the insulated conductor into said insulation piercing means and at least partially closing or reducing the dimensions of said open side to urge and maintain a pierced insulated conductor within said channel.

7. Method as defined in claim 6, further comprising the step of displacing the insulation of the conductor with insulation piercing means within said channel for piercing insulation on an insulated conductor positioned between said side walls upon application of a force applied urging the insulated conductor into said channel towards said bottom wall.

8. Method as defined in claim 6, further comprising the step of holding the conductor in said channel prior to crimping.

9. Method as defined in claim 8, wherein said holding step comprises providing an interference fit within said channel whereby insertion of the conductor into said channel creates a press-fit temporarily holding the conductor in said channel during crimping.

10. A crimping tool for comprising a surface mount insulation terminal for connection to an insulated conductor having a predetermined substantially uniform external cross-sectional dimension, comprising a generally flat deformable conductive member configured to have an elongate generally uniform U-shaped cross-section along its entire elongate length to define a wire-receiving channel along its length and having a conductive bottom wall suitable for contact with and attachment to a land or pad on a printed circuit board, and a pair of spaced substantially parallel side wall for receiving a length of an insulated conductor between said side walls through an open side opposite to said bottom wall, said side walls being spaced from each other a distance substantially equal to the external cross-sectional dimension of the insulated conductor; insulation piercing means within said channel extending from said flat bottom wall towards said open side for piercing insulation on an insulated conductor positioned between said side walls upon application of a force applied urging the insulated conductor into said channel towards said bottom wall, said side walls being capable of being crimped or bent inwardly towards each other and towards said bottom wall to at least partially close or reduce the dimensions of said open side to urge and maintain a pierced insulated conductor within said channel, the crimping tool comprises a movable block capable of being aligned with and applying a pressure on said side walls, said block having a recess having a width substantially equal to the spacing between said side walls for initially receiving said side walls within said recess when the crimping tool is positioned at a predetermined height above said bottom wall and said recess exhibiting gradually decreasing width interacting with said side walls as said height is gradually decreased below said predetermined height; and pressure applying means for selectively applying pressure on said crimping tool to crimp said side walls to urge and maintain mechanical and electrical contact with a conductor within said channel.

11. A crimping tool as defined in claim 10, wherein said recess is elongated and comprises a substantially uniform cross-section.

12. A crimping tool as defined in claim 11, wherein said cross-section is an inverted U-shape.

13. A crimping tool as defined in claim 12, wherein said U-shape defines a region of continuously decreasing width.

14. A crimping tool as defined in claim 13, wherein said U-shape includes an arcuate surface.

15. A crimping tool as defined in claim 10, further including lead in surfaces for enhancing alignment between the crimping tool and said side walls.

16. A crimping tool as defined in claim 15, wherein said lead in surfaces comprise chamfers or beveled edges on leading surfaces of said recess first receiving said side walls.

17. A blank for forming a surface mount insulation terminal for connection to an insulated conductor having a predetermined substantially uniform external cross-sectional dimension, comprising a generally flat deformable conductive member configured to have an elongate generally uniform U-shaped cross-section along its entire elongate length to define a wire-receiving channel along its length and having a conductive bottom wall suitable for contact with and attachment to a land or pad on a printed circuit board, and a pair of spaced substantially parallel side walls, for receiving a length of an insulated conductor between said side walls through an open side opposite to said bottom wall, said side walls being spaced from each other a distance substantially equal to the external cross-sectional dimension of the insulated conductor; insulation piercing means within said channel extending from said flat bottom wall towards said open side for piecing insulation on an insulated conductor positioned between said side walls upon application of a force applied urging the insulated conductor into said channel towards said bottom wall, said side walls being capable of being crimped or bent inwardly towards each other and towards said bottom wall to at least partially close or reduce the dimensions of said open side to urge and maintain a pierced insulated conductor within said channel, wherein the blank includes coined triangular-shaped members formed in the said bottom wall substantially normal to said bottom wall.

* * * * *